US006694683B2

(12) United States Patent
Anderson et al.

(10) Patent No.: US 6,694,683 B2
(45) Date of Patent: Feb. 24, 2004

(54) SIGHT GLASS RETAINER SYSTEM AND METHOD FOR MAKING SAME

(75) Inventors: Jeffrey D. Anderson, South Elgin, IL (US); Kent D. Homfeldt, Elgin, IL (US)

(73) Assignee: Illinois Tool Works Inc., Glenview, IL (US)

( * ) Notice: Subject to any disclaimer, the term of this patent is extended or adjusted under 35 U.S.C. 154(b) by 210 days.

(21) Appl. No.: 10/032,605

(22) Filed: Oct. 19, 2001

(65) Prior Publication Data

US 2003/0076610 A1 Apr. 24, 2003

(51) Int. Cl.[7] ..... E06B 3/00

(52) U.S. Cl. ..... 52/204.5; 52/208; 52/204.53; 52/204.64; 52/204.69; 40/757; 40/768; 40/651; 40/653; 431/13; 431/17; 432/250

(58) Field of Search ..... 52/208, 204.53, 52/204.64, 204.69, 204.5; 40/757, 768, 651, 653; 431/13, 17; 432/250

(56) References Cited

U.S. PATENT DOCUMENTS 4,193,238 A * 3/1980 Chalmers et al. ..... 52/204.53
4,700,525 A * 10/1987 Nieboer et al. ..... 52/698
6,378,931 B1 * 4/2002 Kolluri et al. ..... 296/146.15
6,547,558 B2 * 4/2003 McCall ..... 432/250
6,554,610 B2 * 4/2003 McCall ..... 432/250

* cited by examiner

*Primary Examiner*—Carl D. Friedman
*Assistant Examiner*—Steve Varner
(74) *Attorney, Agent, or Firm*—Mark W. Croll; Paul F. Donovan

(57) ABSTRACT

A sight glass retaining system is provided for mounting a sight glass to a support panel, such as for viewing combustion or other processes. The system includes a retainer which forms a continuous frame and has lateral flanges for locating the sight glass. Retaining tabs extend from the frame and support resilient retaining portions which snap into engagement with the support panel. A resilient element, which may form a seal with the sight glass and support panel, urges the assembly in compression to maintain tight engagement of the components, and generally column loads the retaining portions to preclude movement of the assembly on the support panel.

35 Claims, 4 Drawing Sheets

FIG. 8
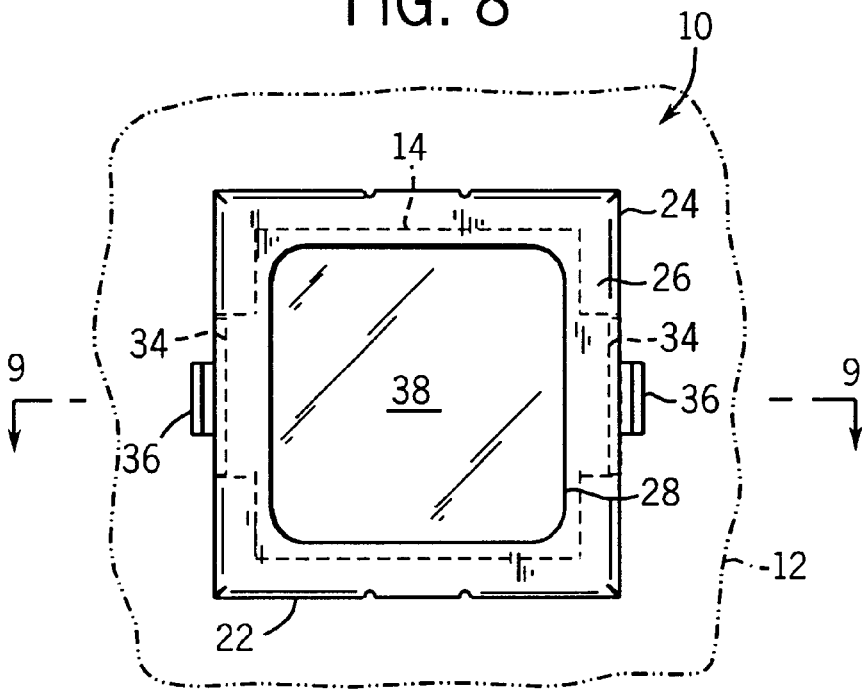
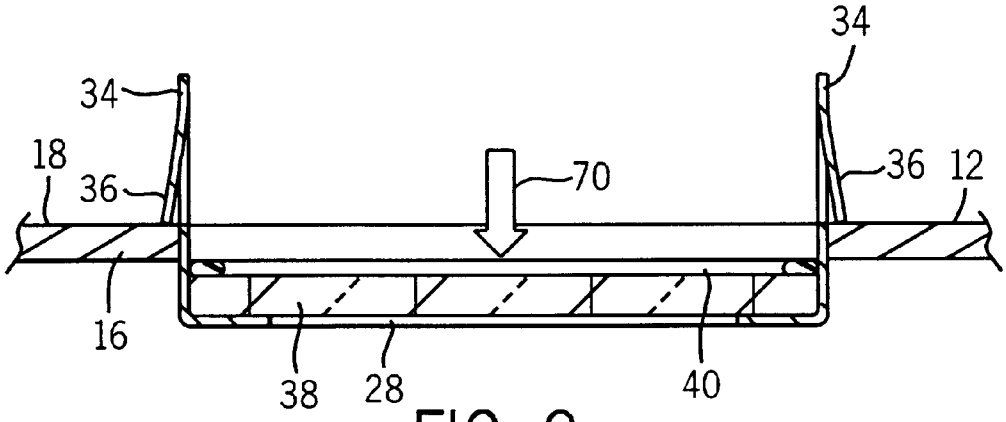
FIG. 9

SIGHT GLASS RETAINER SYSTEM AND METHOD FOR MAKING SAME

BACKGROUND OF THE INVENTION

The present invention relates generally to the field of sight glasses and retaining structures for such devices. More particularly, the invention relates to a novel sight glass retaining system which facilitates installation and effective retention of a sight glass in a cost-effective assembly.

A number of applications exist for sight glasses and similar structures. In general, sight glasses permit viewing of an article or process through a barrier or panel which would otherwise occlude vision. By way of example, in combustion chambers, furnaces, water heaters, and the like, pilot flames and combustion may take place in a closed combustion chamber. A combustion chamber may, in fact, be sealed, or may be simply shielded by surrounding panels. The panels may typically be made of a combustion-resistant material, such as sheet metal, and may include insulation layers on one or both sides. In general, however, such panels or barriers preclude visual assessment of processes occurring within the enclosed chamber. Such visual assessment is often useful to determine whether the processes are proceeding normally, or whether servicing or other action is necessary. In furnaces and water heating applications, for example, it may be useful to assess whether pilot flames are lit or active, electric heating elements are activated, combustion is ongoing, and so forth.

Various arrangements have been proposed and are presently in use for providing sight glasses in such applications. In certain conventional arrangements, for example, sight glasses are retained by screw-on clips, tack-welded assemblies, and so forth. While such retaining systems generally provide for adequate mounting and retention of sight glasses, they are not without drawbacks. For example, manufacturing processes for forming and mounting such arrangements may be somewhat costly and time-consuming. Where tack-welded arrangements are employed, special processing of the components, including the retainer and panel may be required. Moreover, such arrangements may limit or even make impossible the ability to seal the sight glass either within the retainer, against the panel, or both. Finally, conventional arrangements may limit or even make impossible the eventual servicing or replacement of the sight glass or retainer.

There is a need, therefore, for an improved technique for retaining sight glasses and similar structures. There is a particular need for a straightforward and cost-effective structure which effectively mounts a sight glass or similar component in various applications such as those discussed above.

SUMMARY OF THE INVENTION

The present invention provides a sight glass retention system designed to respond to such needs. The technique may be employed in a wide variety of settings, and is generally applicable to any setting in which a planar or curved sight glass or similar panel is to be held and retained on a mounting or support surface. In a present configuration, the system is adapted for mounting a sight glass on a support panel, such as might be found in a furnace, water heater, process equipment, and the like. The technique makes use of a retainer that forms a frame behind which the sight glass is positioned. Retaining tabs are formed on peripheral flanges around the frame and are designed to interface with mating features of the support panel. In one embodiment, for example, resilient retaining portions are formed in the retaining tabs that clip into place once the assembly is mounted on the support panel. The retaining portions contact a rear surface of the support panel to maintain the retainer and sight glass in position, such as adjacent to an aperture through which a process can be viewed. One or more seals or gaskets may be provided in the assembly. A sealing element, for example, may be applied directly to or around the sight glass and compressed against the inner surface of the retainer or against the outer surface of the support panel, or both, to provide sealing engagement at those locations. The sealing element may be sufficiently resilient to undergo elastic compression during mounting, thereby forcing tight engagement of the retainer, sight glass and retaining tabs following installation.

The technique also provides for forming and configuring the retaining system, particularly the retainer itself. The retainer may be made of any suitable material, such as metal. In an exemplary process for making the retainer, a blank is stamped from sheet metal and peripheral flanges surrounding the frame portion of the retainer are bent in a progressive dye or other tooling. The retaining portions formed on the retaining tabs may be sheered and bent during this process so as to force them to extend in a direction from the retaining tabs as desired to contact the support panel when the assembly is clipped into place. The flanges formed around the frame portion of the retainer by the bending operation serve to locate and retain the sight glass in the assembly. The sight glass may then be mounted into the retainer and the sealing element placed either on the support panel or on the sight glass or frame. In exemplary implementation, a bead of resilient material is applied directly to the sight glass which can then be dropped into the retainer and the entire assembly is snapped into place on the support panel.

BRIEF DESCRIPTION OF THE DRAWINGS

The foregoing and other advantages of the invention will become apparent upon reading the following detailed description and upon reference to the drawings in which:

FIG. 8 is an elevational view of the retainer of FIG. 6 installed in an application; and FIG. 9 is a sectional view through the assembly of FIG. 8 along line 9—9.

DETAILED DESCRIPTION OF SPECIFIC EMBODIMENTS

Figure 1:
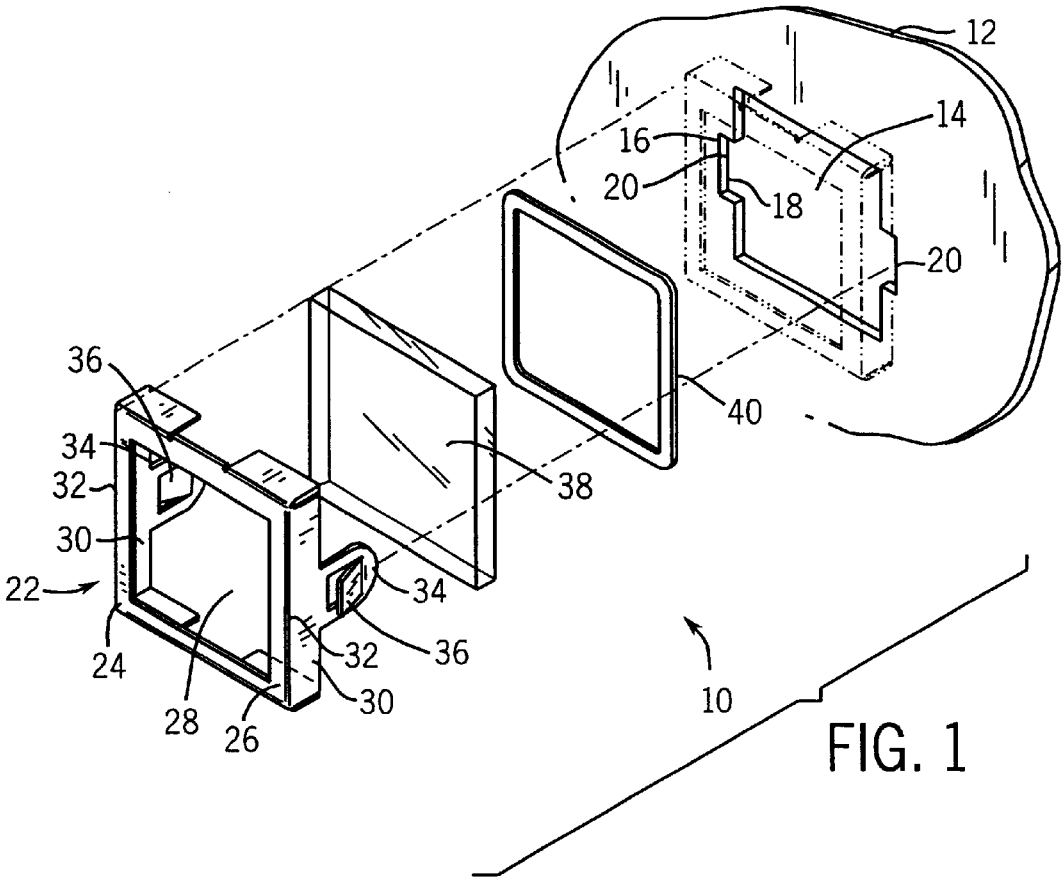
FIG. 1 is an exploded perspective view of a sight glass retaining system in accordance with aspects of the present technique.

Turning now to the drawings, and referring first to FIG. 1, a system for retaining a sight glass is illustrated and designated generally by reference numeral 10. The system is adapted for maintaining a sight glass in a desired position on a support panel 12, such as in front of an aperture 14 through which a process may be viewed. As will be apparent to those skilled in the art, support panel 12 may include any range of materials, environments, and applications. For example, the panel may be a sheet metal-type shell or barrier surrounding a sealed or unsealed combustion chamber, such as in a furnace, water heater, or other process equipment. The panel may include one or more insulating layers (not shown) and may be flat or planar in form, arcuate, or otherwise contoured. In the embodiment illustrated, panel 12 includes an aperture 14 through which a process may be viewed, such as a combustion process in a furnace or water heater application. The retaining system 10 is mounted to a front surface 16 of panel 12 and contacts a rear surface 18 for retention of a sight glass as described more fully below. Recesses 20 are formed in the exemplary aperture of FIG. 1 for receiving mating retaining features of the system, as also described below.

Retaining system 10 includes a retainer 22 which serves to locate the sight glass and to hold the sight glass in the desired position on the support panel 12. Retainer 22 thus forms a frame 24 which may be of any desired shape and, in the illustrated embodiment, is generally planar. Alternative configurations may, of course, be envisaged, including round frames, elongated frames, arcuate frames and so forth. Frame 24 presents a front face 26 through which an aperture 28 is formed. Again, the aperture may be of any desired shape or configuration. Lateral flanges 30 are formed around the frame 24 and extend from the plane of the frame, generally perpendicularly from the frame in the embodiment illustrated. The front face 26 and lateral flanges are joined at an outer periphery 32 from which the flanges extend. Retaining tabs 34 are contiguous with the lateral flanges 30 and extend beyond the limits of the flanges as illustrated. Each retaining tab 34 supports a resilient retaining portion 36 which is contiguous with the respective retaining tab but which is bent out of the plane of the retaining tab. As discussed in greater detail below, retaining portions 36 may be plastically bent or deformed from the retaining tabs 34 during manufacture of the retainer, and are elastically deformed during insertion through panel 12 as the retainer is mounted. The retaining portions then return to their original orientation and contact the rear surface 18 of the panel. The retainer 22 is adapted to position and retain a sight glass as indicated at reference numeral 38 in FIG. 1. As discussed in greater detail below, the retainer both positions and retains the sight glass behind aperture 28. As also discussed in greater detail below, one or more resilient, elastic or sealing elements 40 may be provided in the system for urging the sight glass 38 against the panel 12 or against the retainer 22, or both.

Figure 2:
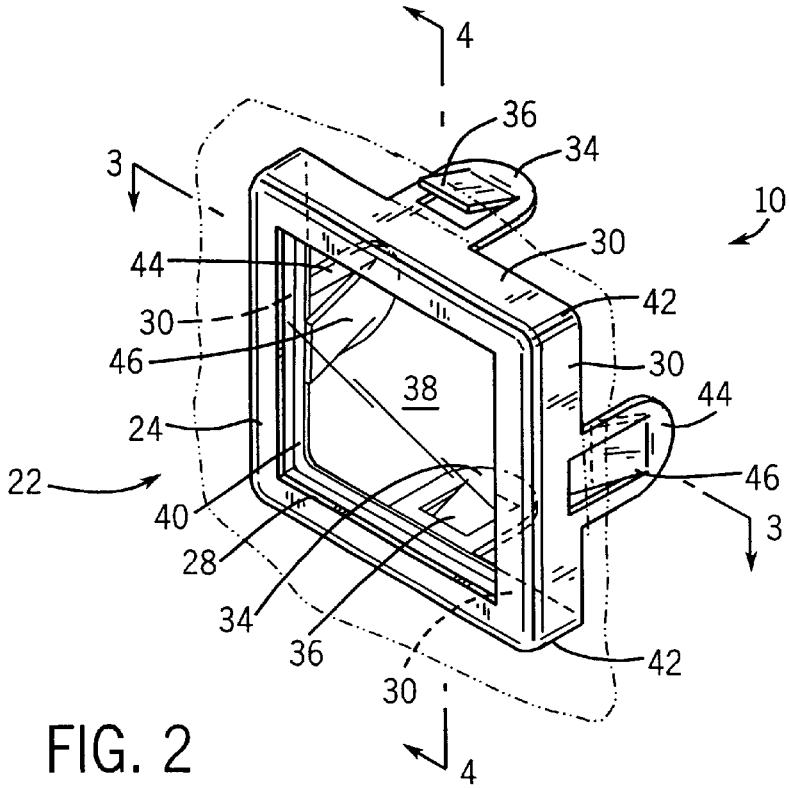
FIG. 2 is a prospective view of a slightly different configuration for a sight glass retainer for use in an application of the type shown in FIG. 1.

FIG. 2 illustrates a somewhat different alternative configuration for retainer 22. In the embodiment of FIG. 2, the retainer may be formed through a drawing operation so as to provide contiguous corners 42 at compared to the corners of the retainer illustrated in FIG. 1. Other features of the embodiment illustrated in FIG. 2 are similar to those of the embodiment of FIG. 1, including the frame 24 and front face 26 through which aperture 28 is formed. As in the previous embodiment, the embodiment of FIG. 2 also includes lateral flanges 30 from which retaining tabs 34 extend, the retaining tabs presenting retaining portions 36 for securing the retainer to a support panel of the type illustrated in FIG. 1. The embodiment of FIG. 2 also includes sight glass securement tabs 44 which extend from lateral flanges 30 on alternative sides from the retaining tabs 34. The sight glass securement tabs 44, which may be generally similar to tabs 34, support retaining portions 46 which, rather than extending outwardly as in the case of retaining tabs 34, extend inwardly towards the location of the sight glass within the assembly. The retaining portions 46 are similarly resilient so as to be elastically deformable for mounting of the sight glass within the assembly, where desired.

Figure 3:
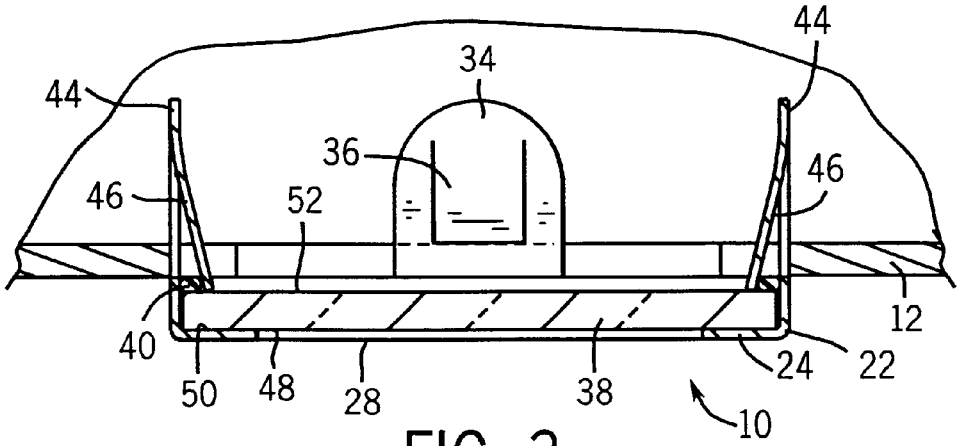
FIG. 3 is a sectional view of the retainer of FIG. 2 along line 3—3.

FIG. 3 illustrates a sectional view of the assembly of FIG. 2 along line 3—3. As shown in FIG. 3, once assembled on panel 12, sight glass securement tabs 44 will extend through the panel. The front side 48 of sight glass 38 contacts the rear side of frame 50 and is maintained in tight engagement against the rear side of the frame in the mounted assembly. Retaining portions 46 of sight glass securement tabs 44 extend inwardly, having reassumed their normal position after insertion of the glass in the retainer, to contact a rear side 52 of the sight glass, and thereby to retain the sight glass within the frame, or may be slightly spaced from the glass, so as to hold the glass in the assembly prior to final installation on the support panel. The sealing element 40 is captured between the sight glass 38 and the panel 12 and is preferably somewhat compressed in this location to exert a sealing or engagement force against the panel 12 and sight glass 38.

Figure 4:
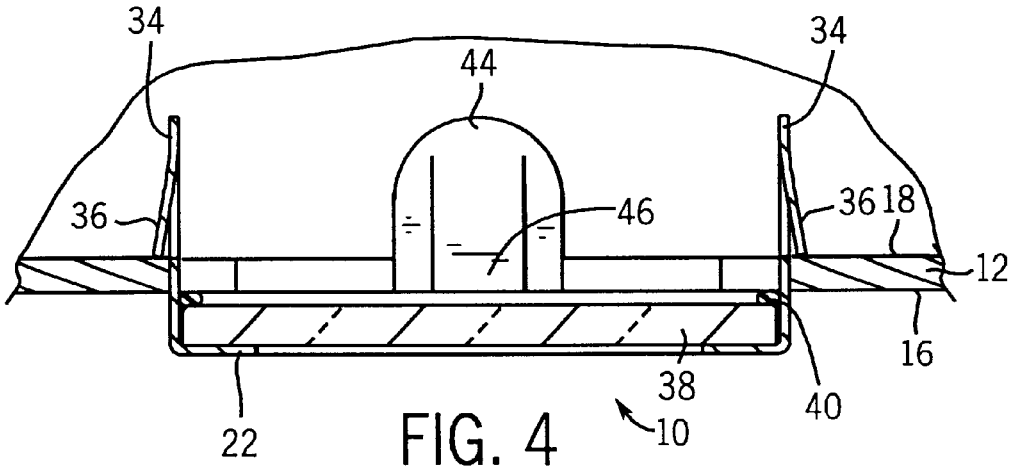
FIG. 4 is a sectional view of the retainer of FIG. 2 along line 4—4.

FIG. 4 is a sectional view of the assembly of FIG. 2 along line 4—4, similarly mounted to support panel 12. As shown in FIG. 4, when mounted on panel 12, the retaining tabs 34 of the retainer extend through the panel, and resilient retaining portions 36, having been elastically deformed during insertion, reassume their original orientation. Thus, the retaining portions 36 are generally column loaded in compressive contact with the rear surface 18 of panel 12 to maintain the retainer, sight glass, and sealing element 40 in tight engagement against the support panel.

Figure 5:
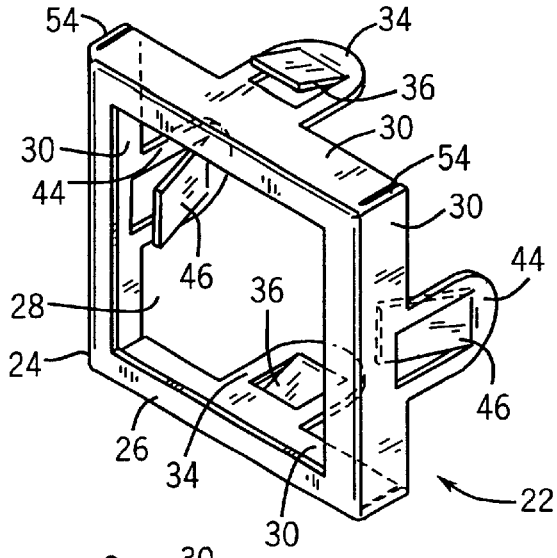
FIG. 5 is a perspective view of a further alternative configuration for a sight glass retainer incorporating features both of the embodiment of FIG. 1 and that of FIG. 2.

As noted above, various techniques may be provided for forming the embodiments described herein. For example, the retainer 22 of FIGS. 2, 3 and 4 is formed by a molding or drawing operations so as to provide a smooth, continuous surface around the frame and corners 42 shown in FIG. 2. As illustrated in FIG. 5, a substantially identical arrangement, from a retention standpoint, may be formed through stamping, sheering and bending operations. In this embodiment, open corners 54 are formed at locations where peripheral flanges 30 approach one another. The corners may be left open in applications, or may be joined, such as through welding or soldering, where desired. The embodiment of FIG. 5 is generally identical to that of FIG. 2 in other respects.

Figure 6:
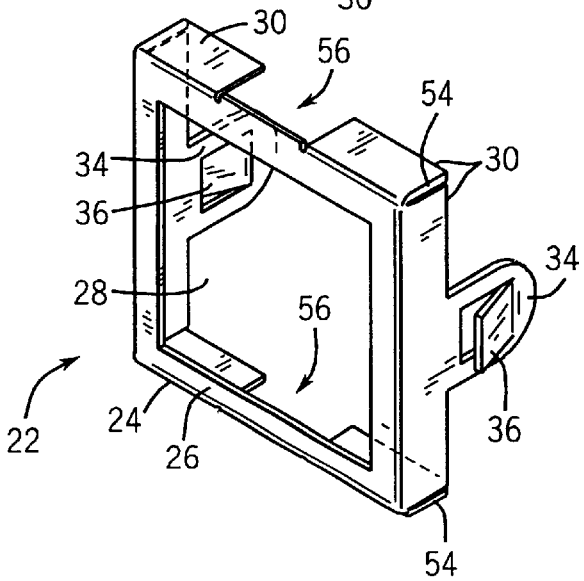
FIG. 6 is a perspective view of a retainer of the type shown in FIG. 1.

As shown in FIG. 6, in a further alternative configuration, similar to that illustrated previously in FIG. 1, similar open corners 54 are formed through a retainer made by stamping, sheering and bending operations. In the embodiment of FIG. 6, however, only retaining tabs 34 are provided, each supporting a resilient retaining portion 36 which functions substantially as described above with reference to FIG. 4. The embodiment of FIG. 6 does not include tabs or features for retaining a sight glass, but serves to appropriately locate the sight glass in an application as described above. Where desired, the sight glass may be simply positioned loosely within the retainer, or one or more sealing elements may be provided which exert compressive forces for tightly engaging the sight glass between the retainer frame and support panel as described above. The embodiment of FIG. 6 also presents recesses 56 within the lateral flanges 30 at alternate locations from the retaining tabs 34. Recesses 56 may add somewhat to the resiliency of the retainer as it is positioned in an application, and they facilitate displacement of the assembly in the manufacturing process.

Manufacturing of the retainer in the various embodiments described above may proceed through various stages. In the case of a molded or drawn structure, the various features described above may be formed in a single operation. Alternatively, a structure similar to that illustrated in FIG. 2 may be formed by molding or drawing, with retaining portions 36 and, if provided, 46, being sheered and bent from the respective retaining tabs in a separate operation. In present embodiments, however, the retainer is formed by stamping or sheering sheet metal and bending the sheet metal in a progressive dye or other tooling. An exemplary blank for forming the retainer of FIG. 6 is illustrated in FIG. 7.

Figure 7:
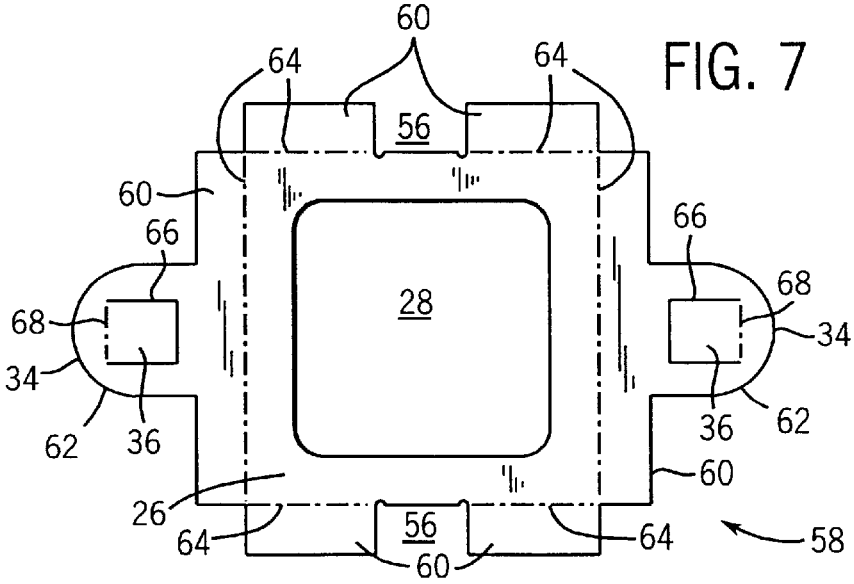
FIG. 7 is a plan view of a blank for forming a sight glass retainer of the type shown in FIG. 6.

As shown in FIG. 7, blank 58 may be formed by any appropriate process, such as stamping or sheering. The blank 58 presents features which will be formed through the stages of a progressive dye or other tooling into those features described above with reference to FIG. 6. The features have been identified by reference numerals in FIG. 7 for comparison purposes. In general, the blank 58 presents extensions 60 which are designed to form flanges 30 in the final retainer. Similar extensions 62 are designed to form the retaining tabs 34 in the final retainer. Once the blank 58 is formed, extensions 60 are bent along bend lines 64 to form the flanges described above which extend from the plane of the front face 26 of the retainer. Also during these progressive operations, resilient retaining portions 36 are formed by sheering the material as indicated by the sheer lines 66 in FIG. 7. The retaining portions 36 are then plastically bent from the plane of the respective retaining tab 36 along bend lines 68. The resulting retainer has the form of that illustrated in FIG. 6.

FIG. 8 is an elevational view of the retainer system incorporating a retainer of the type illustrated in FIG. 6. As shown in FIG. 8, when mounted on the support panel 12, the retainer 22 fixes the sight glass 38 between the frame 24 and the support panel 12. The sight glass is secured in the desired position by the peripheral walls or lateral flanges of the retainer 22. Moreover, the retaining tabs 34 extend through the support panel 12 and contact the support panel with the retaining portions 36 being generally column loaded against the support panel to hold the entire assembly tightly in place.

As shown in the sectional view of FIG. 9, the sight glass 38 is held tightly between the frame 24 and the support panel 12 by the contact of the retaining portions 36 with the rear surface 18 of the support panel. The presence of the resilient element 40, which may also serve as a seal, causes the retaining portions 36 to be loaded, and exerts compressive forces against the sight glass 38 and frame 24 as indicated by arrow 70 in FIG. 9. In addition to a resilient element 40 being placed between the panel 12 and the sight glass 38, an additional resilient element (not shown) may be placed between the frame 24 and the sight glass 38. Again, one or both of these resilient elements may comprise a continuous or intermittent bead of resilient material, such as silicon rubber, applied directly to the sight glass. Alternative configurations might include preformed resilient gaskets or seals which may be adhesively applied to the sight glass prior to or during assembly with the frame.

While the invention may be susceptible to various modifications and alternative forms, specific embodiments have been shown in the drawings and have been described in detail herein by way of example only. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A sight glass retainer system comprising:

a continuous frame extending generally in a plane and having an aperture for a sight glass and an outer periphery;

lateral flanges bent and extending from the frame for receiving and positioning a sight glass;

first and second retaining tabs extending from the outer periphery of the frame generally transverse to the plane of the frame, the retaining tabs including resilient retaining portions configured to contact a rear side of a support and thereby to retain the frame in a desired location on a front side of the support;

a sight glass disposed on a side of the frame from which the retaining tabs extend; and a resilient element in contact with the sight glass and interposed between the sight glass and the support.

2. The retainer system of claim 1, wherein the flange portions contiguous with the frame and extending transverse to the plane of the frame, and form open corners at locations corresponding to corners of the frame.

3. The retainer system of claim 2, wherein first retaining tab is contiguous with a first flange portion and the second retaining tab is contiguous with a second flange portion at a diametrically opposed location from the first retaining tab.

4. The retainer system of claim 1, wherein each retaining portion extends outwardly from the respective retaining tab with respect to the aperture of the frame, and is elastically deformable inwardly for insertion through the support.

5. The retainer system of claim 4, wherein each retaining portion includes material contiguous with the respective tab and plastically bent from a plane of the respective tab.

6. The retainer system of claim 1, further comprising a pair of sight glass securement tabs extending transverse to the plane of the frame and configured to contact and retain a the sight glass on a rear side of the frame.

7. The retainer system of claim 1, wherein the frame and retaining tabs are made of a single piece of metal.

8. The retainer system of claim 1, wherein the resilient element is disposed directly on and adheres to the sight glass.

9. The retainer of claim 8, wherein the resilient element comprises a continuous bead of a resilient material.

10. The retainer system of claim 1, wherein the resilient element is configured to exert a force transmitted to the retainer tending to maintain the retaining portions of the tabs in contact with the rear side of the support.

11. The retainer system of claim 1, wherein the resilient element forms a continuous seal between the sight glass and the support.

12. A system for retaining a sight glass on a support panel, the support panel having an opening through which visibility is desired, the system comprising:

a retainer having a continuous frame and first and second retaining tabs, the frame extending generally in a plane and having an aperture for a sight glass and an outer periphery, the first and second retaining tabs extending from the outer periphery of the frame generally transverse to the plane of the frame, the retaining tabs including resilient retaining portions configured to contact a rear side of the support panel and thereby to retain the frame in a desired location on a front side of the support panel;

a sight glass disposed on a rear side of the frame and between the retaining tabs; and a resilient element contacting the sight glass and configured to contact the support panel to exert a force transmitted to the retainer to maintain the retaining portions of the tabs in contact with the rear side of the support panel when the system is mounted to the support panel.

13. The system of claim 11, wherein the elastic element is disposed on the sight glass.

14. The system of claim 12, wherein the elastic element is configured to form a continuous seal between the sight glass and the support panel when the system is mounted to the support panel.

15. The system of claim 14, wherein the outer periphery includes flange portions contiguous with the frame and extending transverse to the plane of the frame.

16. The system of claim 15, wherein first retaining tab is contiguous with a first flange portion and the second retaining tab is contiguous with a second flange portion at a diametrically opposed location from the first retaining tab.

17. The system of claim 12, wherein each retaining portion extends outwardly from the respective retaining tab with respect to the aperture of the frame, and is elastically deformable inwardly for insertion through the support panel opening.

18. The system of claim 17, wherein each retaining portion includes material contiguous with the respective tab and plastically bent from a plane of the respective tab.

19. The system of claim 12, further comprising a pair of sight glass securement tabs extending transverse to the plane of the frame and configured to contact and retain the sight glass on the rear side of the frame.

20. A method for mounting a sight glass on a support panel, the method comprising:

providing a retainer having a continuous frame and first and second retaining tabs, the frame extending generally in a plane and having an aperture for a sight glass and an outer periphery, the first and second retaining tabs extending from the outer periphery of the frame generally transverse to the plane of the frame, the retaining tabs including resilient retaining portions configured to contact a rear side of the support panel and thereby to retain the frame in a desired location on a front side of the support panel;

disposing a sight glass on a rear side of the frame and between the retaining tabs;

disposing an elastic element on a rear side of the sight glass opposite the frame; and mounting the retainer, sight glass and elastic element on the support panel such that the retaining tabs extend through the support panel and the elastic element exerts a force on the front side of the support panel that is transmitted to the retainer to maintain the retaining portions in contact with the rear side of the support panel.

21. The method of claim 20, wherein the elastic element forms a continuous seal between the sight glass and the support panel.

22. The method of claim 20, wherein the retainer includes flange portions contiguous with the frame and extending generally transverse to the plane of the frame, and wherein the sight glass is disposed between the flange portions.

23. The method of claim 20, wherein the elastic element includes a bead of a resilient sealing material disposed directly on the rear side of the sight glass.

24. The method of claim 20, wherein the retainer further comprises a pair of sight glass securement tabs extending transverse to the plane of the frame and configured to contact and retain the sight glass on the rear side of the frame.

25. A method for making a sight glass retainer, the method comprising:

forming a single piece retainer blank from a sheet of metal, the blank including a frame portion surrounding a central aperture and tab portions extending from the frame portion;

forming retaining portions within tab portions;

plastically bending the retaining portions with respect to surrounding material of the each respective tab portion, such that at least one retaining portion extends inwardly with respect to the frame portion, and at least one retaining portion extends outwardly with respect to the frame portion; and bending the tab portions to extend generally transverse to a plane of the frame portion.

26. The method of claim 25, wherein the tab portions extend from the frame portions at diametrically opposed locations.

27. The method of claim 25, wherein the blank further includes flange portions around sides of the frame portion, and wherein the flange portions are bent to extend generally transverse to the plane of the frame portion.

28. The method of claim 27, wherein the tab portions are contiguous with and extend from respective flange portions, and wherein the tab portions are bent to extend generally transverse to the plane of the frame portion by bending of the respective flange portions from which they extend.

29. The method of claim 25, wherein the retaining portions are sheared and bent prior to bending of the tap portions.

30. The method of claim 25, wherein the forming and bending steps are performed in a progressive die.

31. A method for forming a sight glass retainer, the method comprising:

forming a metallic retainer blank including a frame portion surrounding a central aperture and tab portions extending from the frame portion at diametrically opposed locations about the frame portion, the blank further including flange portions around sides of the frame portion, the flange portions being formed to extend generally transverse to a plane of the frame portion, such that the tab portions are contiguous with and extend from respective flange portions, the flange portions being configured to receive and surround a sight glass and a sealing element;

forming retaining portions within the tab portions;

plastically bending the retaining portions with respect to surrounding material of the each respective tab portion; and bending the tab portions to extend generally transverse to the plane of the frame portion.

32. The method of claim 31, wherein the aperture is formed prior to forming the retaining portions.

33. The method of claim 31, wherein the aperture is formed prior to plastically bending the retaining portions.

34. The method of claim 31, wherein the retaining portions are formed by sheering the tab portions.

35. The method of claim 31, wherein the retaining portions are plastically bent prior to bending of the tab portions.

* * * * *

UNITED STATES PATENT AND TRADEMARK OFFICE

CERTIFICATE OF CORRECTION

PATENT NO. : 6,694,683 B2
DATED : February 24, 2004
INVENTOR(S) : Anderson et al.

It is certified that error appears in the above-identified patent and that said Letters Patent is hereby corrected as shown below:

Column 7,
Line 9, change the dependency of claim 13 from “claim 11” to -- claim 12 --.
Line 15, change the dependency of claim 15 from “claim 14” to -- claim 12 --.

Signed and Sealed this

Eleventh Day of May, 2004

JON W. DUDAS
*Acting Director of the United States Patent and Trademark Office*